US009095896B2

(12) United States Patent
Vincent

(10) Patent No.: US 9,095,896 B2
(45) **Date of Patent: *Aug. 4, 2015**

(54) HEATED MOLTEN METAL HANDLING DEVICE

(75) Inventor: Mark Vincent, Leighton Buzzard (GB)

(73) Assignee: Pyrotek, Inc., Spokane, WA (US)

( * ) Notice: Subject to any disclaimer, the term of this patent is extended or adjusted under 35 U.S.C. 154(b) by 421 days.

This patent is subject to a terminal disclaimer.

(21) Appl. No.: 12/290,735

(22) Filed: Nov. 3, 2008

(65) Prior Publication Data

US 2010/0109210 A1 May 6, 2010

(51) Int. Cl.
*B22D 41/02* (2006.01)
*B22D 41/01* (2006.01)

(52) U.S. Cl.
CPC ..... *B22D 41/02* (2013.01); *B22D 41/01* (2013.01)

(58) Field of Classification Search
CPC ..... F27D 3/145; B22D 35/04; B22D 41/04
USPC ..... 266/280, 196, 200, 231
See application file for complete search history.

(56) References Cited

U.S. PATENT DOCUMENTS

| | | | | |
|---|---|---|---|---|
| 3,751,571 | A * | 8/1973 | Burrows | 373/155 |
| 4,345,743 | A * | 8/1982 | Sivilotti et al. | 266/44 |
| 6,444,165 | B1 * | 9/2002 | Eckert | 266/196 |
| 6,973,955 | B2 * | 12/2005 | Tingey et al. | 266/231 |
| 2014/0008399 | A1 * | 1/2014 | Vincent | 222/591 |

* cited by examiner

*Primary Examiner* — Scott Kastler
(74) *Attorney, Agent, or Firm* — Wells St. John, PS

(57) ABSTRACT

A molten metal handling device comprising an outer shell defined by a bottom and two side walls, an insulating layer partially filling the outer shell and a thermally conductive castable refractory body for carrying molten metal, the refractory body being within the insulating layer. The device further includes at least one heating element positioned in the insulating layer, adjacent to the refractory body. The refractory body is preferably fabricated from a castable alumina or castable silicon carbide material.

24 Claims, 4 Drawing Sheets

HEATED MOLTEN METAL HANDLING DEVICE

FIELD OF THE INVENTION

The present invention relates to handling devices used in the transfer of molten metals such as aluminum and more specifically to heated such devices designed to maintain the temperature of the molten metal during handling.

BACKGROUND OF THE INVENTION

U.S. Pat. No. 6,973,955 B2 issued Dec. 13, 2005 describes a heated trough for the transfer of molten metal. This patent broadly describes a trough comprising an outer shell defined by a bottom wall and two side walls, an insulating layer filling the outer shell and a conductive U-shaped refractory trough body for carrying molten metal, the trough body being embedded in the insulating layer. The device of this patent further includes at least one heating element positioned in the insulating layer, adjacent to but spaced apart from the trough body, to provide an air gap between the heating element and the trough body. The trough is described as being fabricated from a material that is generally highly conductive and resistant to corrosion from molten metal. The only examples of suitable such materials provided in this patent are dense refractories such as silicon carbide and graphite. No definition of the terminology "highly conductive" is presented in this patent. Presumably this term as used in this patent is meant to refer to thermal conductivity since the structure described is utilized to impart heat to molten metal being transferred in the trough. From the literature, it is known that silicon carbide has a thermal conductivity on the order of about 100-300 W/m-K°, and graphite is reported to have a thermal conductivity on the order of above 100 W/m-K° (see www.matweb.com that provides materials properties data of this type). Thus, to the skilled artisan, these materials would be recognized as "highly thermal conductive".

While the foregoing device provides a useful tool for the maintenance of molten metals temperature during transfer in a trough, it possesses several inherent commercial and technical weaknesses. Most notably, silicon carbide is a very expensive material that, while providing excellent thermal conductivity as noted hereinabove, and very high resistance to erosion and attack by, for example, molten aluminum, it is very difficult to form into shapes such as troughs. As a general observation, a trough fabricated from such a material would be very expensive to produce, and would in all probability not be commercially viable. As to a graphite trough, again while the thermal conductivity of such a device would be very desirable form the point of view of heat transfer, graphite is generally considered much too prone to oxidation and is furthermore generally quite friable (not particularly wear resistant), thus not providing a trough material of suitable commercial value.

Accordingly there exists a continuing need for a device such as that described in U.S. Pat. No. 6,973,955 B2 that is equally useful, but significantly less expensive to produce while providing heat transfer and wear characteristics adequate for use in most metal transfer applications.

OBJECT OF THE INVENTION

It is therefore an object of the present invention to provide a commercially viable heated molten metal handling device that provides both adequate wear properties and heat transfer characteristics at a commercially acceptable cost.

SUMMARY OF THE INVENTION

According to the present invention there is provided a molten metal handling device comprising an outer shell defined by a bottom and two side walls, an insulating layer partially filling the outer shell and a conductive refractory body comprising a trough or metal containing body for carrying molten metal, the refractory body being within the boundaries of the insulating layer. The device further includes at least one heating element positioned within the insulating layer, in contact with the refractory body. The refractory body is fabricated from a castable alumina or silicon carbide refractory as described hereinafter. Quite unexpectedly, the use of castable refractories as substitutes for the much higher thermal conductivity more conventional silicon carbide and graphite materials described in the prior art in these applications has proven highly successful.

DETAILED DESCRIPTION

Figure 1:
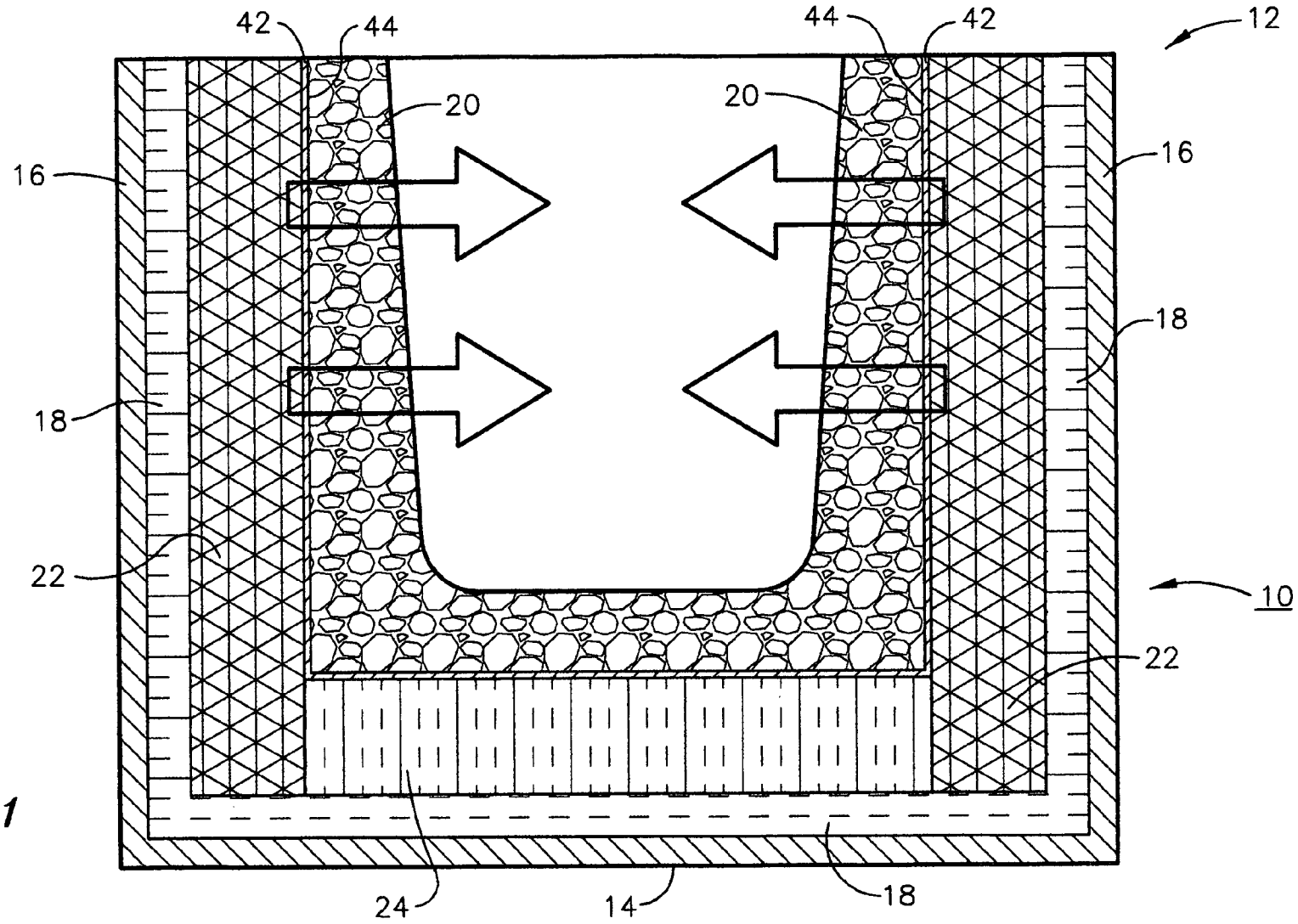
FIG. 1 is a cross-sectional view of a heated trough in accordance with one preferred embodiment of the present invention.

Referring now to FIG. 1 which shows a cross-sectional view of a heated trough that represents one preferred embodiment of the present invention, trough 10 comprises an outer shell 12 having a bottom 14 and side walls 16, an insulating layer 18, a calcined castable refractory trough body 20 within the insulating layer and a heating element(s) 22 positioned between outer shell 12 and calcined castable refractory trough body 20 and in contact with thermally conductive refractory trough body 20. One or more heating elements 22 may be used and these may be positioned as shown in FIG. 1, i.e. between sides 16 and refractory trough body 20. Element 24 in the area of bottom 14 may comprise suitable thermal insulation or, alternatively, an additional heater 22 for imparting heat to calcined castable refractory trough body 20. According to the preferred embodiment shown in FIG. 1, heaters 22 are maintained in position below and along side refractory trough 20 through the use of insulating material supports 18 that comprise an insulating material such as Wollite. Heaters 22 drive heat into refractory trough 20 as shown by the arrows in FIG. 1.

As used herein, the term "castable refractory" is readily understood by those skilled in the refractory shape forming arts and is meant to refer to a composition that can be shaped or molded in the "green state" and then subsequently fired or calcined at a suitable elevated temperature to produce a hard, tough ceramic-like structure having the shape of the shaped or molded "green state" product.

According to the present invention, preferred, but not limiting, castable refractories include: low moisture alumina based refractories such as ArmorKast 65AL commercially available from ANH Refractories Co., Cherrington Corporate Center, 400 Fairway Drive, Moon Township, Pa. 15108 and Pyrocast SC-2600 a high purity silicon carbide based refractory commercially available from Pyrotek, Inc., E. 9503 Montgomery Ave., Spokane, Wash. 99206. The preferred alumina based refractory comprises from about 60 to about 65 weight percent alumina and from about 25 to about 35 weight percent silica in the calcined state. The preferred silicon carbide based refractory comprises from about 80 to about 85 weight percent silicon carbide and from about 10 to about 15 weight percent alumina in the calcined state. While these specific materials are preferred in the successful practice of the present invention, it will be readily understood by the skilled artisan and that many other similar castable refractories demonstrating thermal conductivities similar to these materials may be substituted therefor.

The thermal conductivities of the preferred castable refractory materials in the calcined state are: for the alumina based refractory from about 1.5 to about 1.9 W/m-K°; and for the silicon carbide based refractory from about 9 to about 11 W/m-K°. These thermal conductivities while significantly below those of silicon carbide and graphite as discussed above (and certainly not considered "highly conductive" in the thermal arts) have surprisingly proven highly useful and successful in application to the structure described above while being much more cost effective due to the availability of common commercial production processes and the relatively lower cost of the starting materials when compared to, for example, silicon carbide. Additionally they are significantly "tougher' and more resistant to erosion, abuse and attack by molten metal such as aluminum than graphite.

Figure 2:
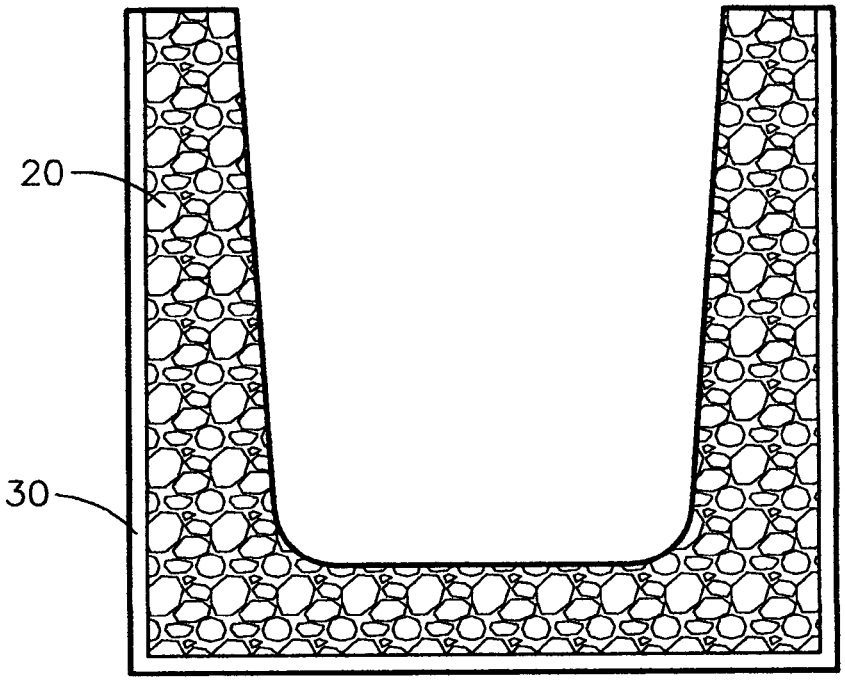
FIG. 2 is a cross-sectional view of an alternative embodiment of the heated trough of the present invention incorporating a metallic fence external to the castable trough lining.
Figure 3:
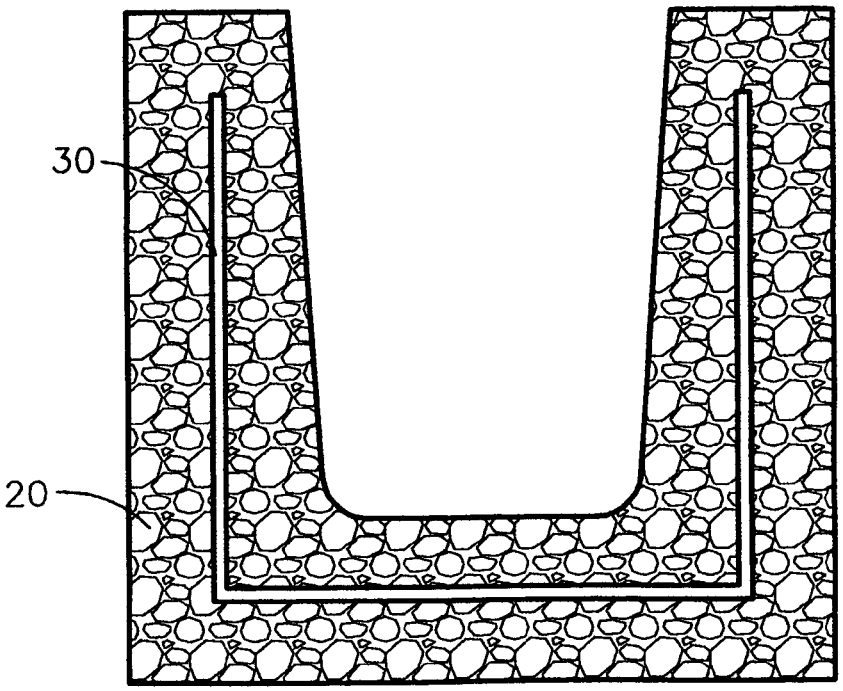
FIG. 3 is a cross-sectional view of another alternative embodiment of the heated trough of the present invention incorporating a metallic fence internal to the castable trough lining.

Referring now to FIGS. 2 and 3 that depict alternative preferred embodiments of the present invention that incorporate a fence 30 either about the periphery of refractory trough 20 (FIG. 2) or cast internally to refractory trough 20 (FIG. 3). The purpose of fence 30 is to provide protection for heater(s) in the case of a perforation of refractory trough 20 through cracking or otherwise. The presence of fence 30 prevents the infiltration of molten metal contained in refractory trough 20 from contacting and destroying heater(s) 22/24.

Fence 30 may is typically between about 1 and 5 mm in thickness, preferably from about 1.5 and about 2.5 mm in thickness and may comprise any number of materials including, but not limited to, a non-oxidizing metallic sheet, a composite ceramic or a glass fabric whose pores have been sealed with a ceramic slurry.

Figure 4:
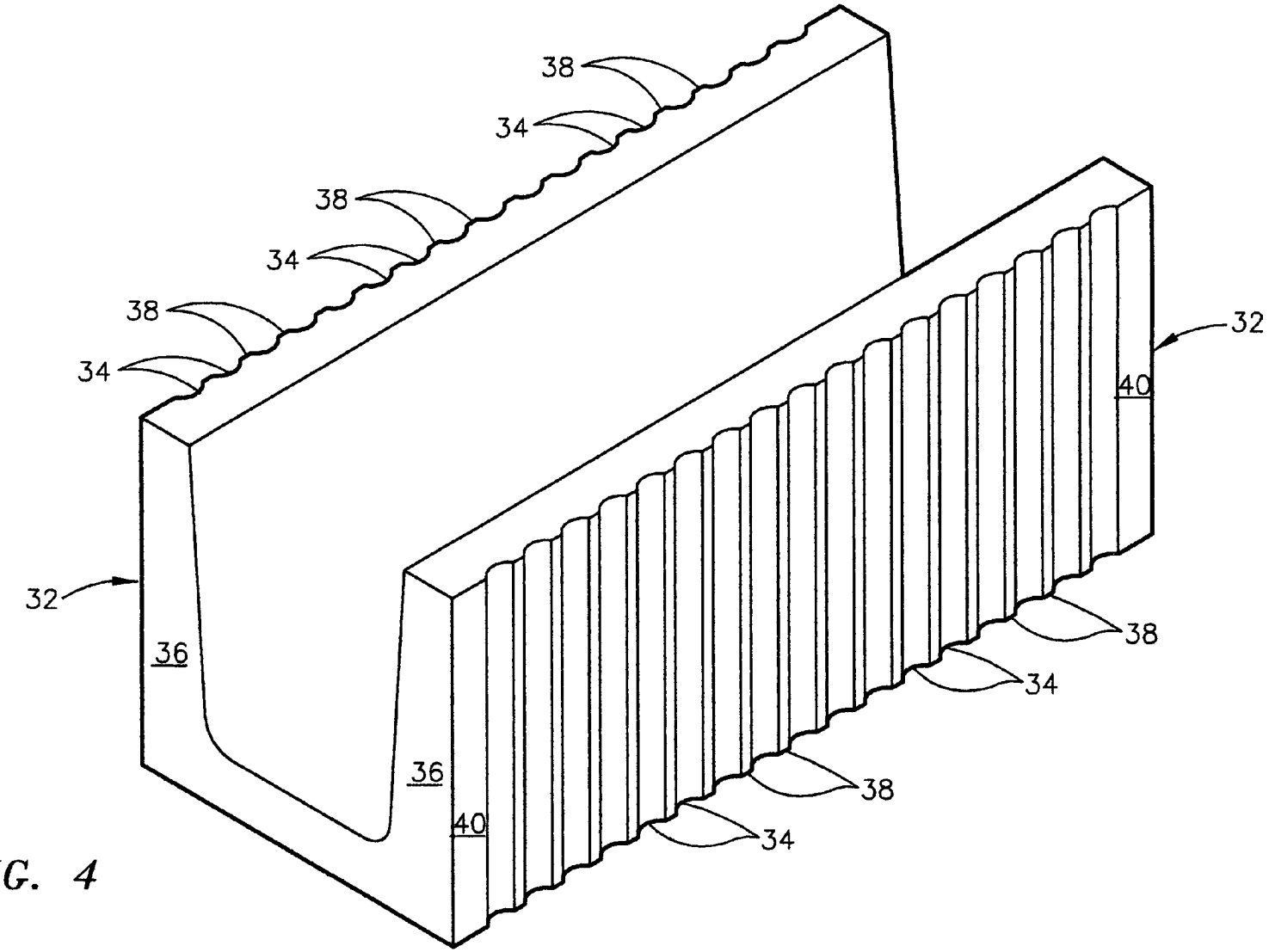
FIG. 4 is yet a perspective view of another alternative embodiment of the heated trough of the present invention wherein the external surface of the castable portion of the trough liner that contacts the heaters has is rippled or defines a wavy pattern.
Figure 5:
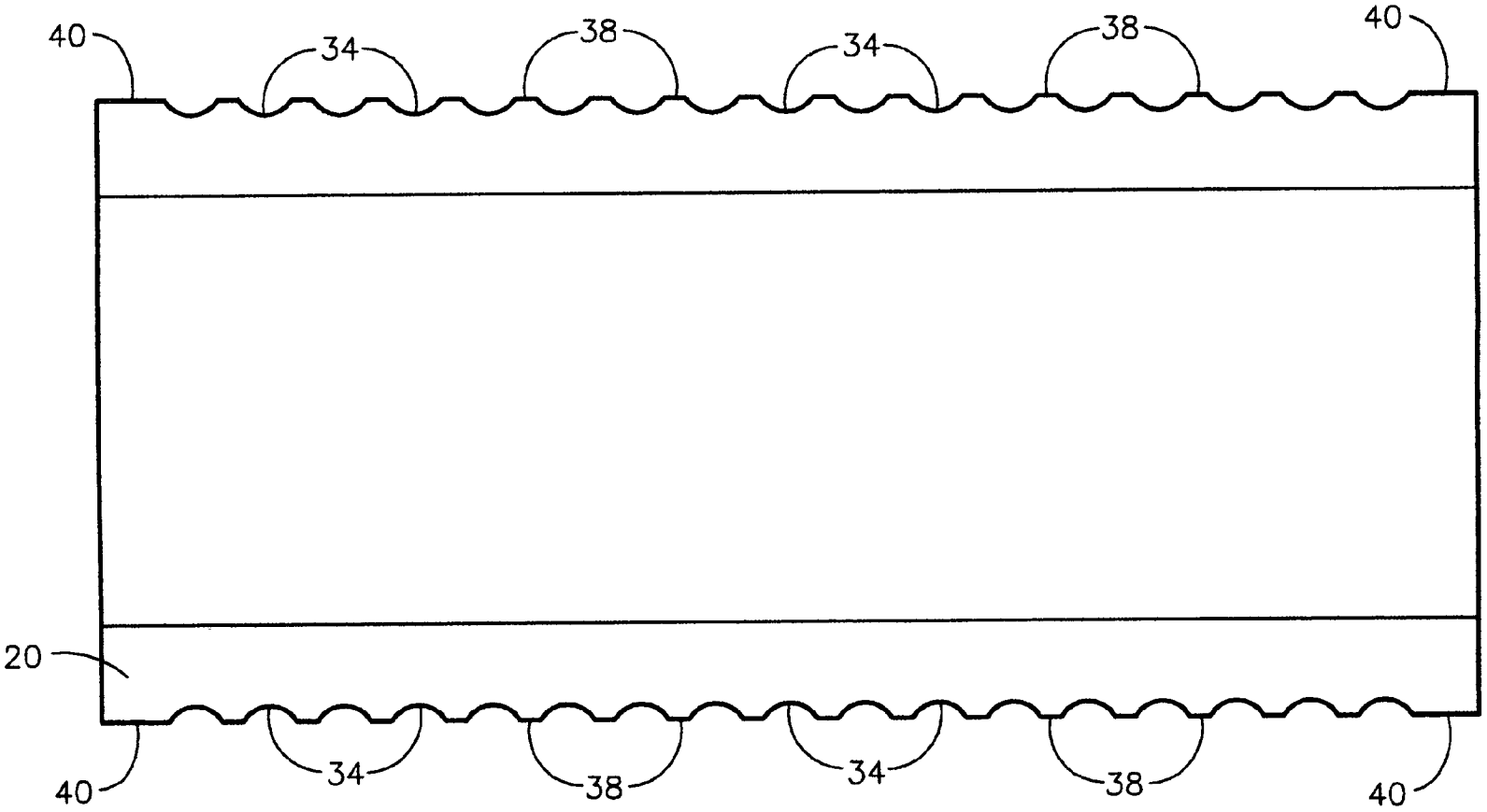
FIG. 5 is a top plan view of the trough liner of FIG. 4.

Depicted in FIGS. 4 and 5 is yet another additional alternative preferred embodiment of the heated trough of the present invention. According to this embodiment, external surfaces 32 of refractory trough 20 are cast in a waved or rippled pattern comprising waves 34. Such a pattern maximizes the surface area exposed to heater(s) 22 thus increasing the effectiveness of heat transfer from heaters 22 to refractory trough 20 all while not weakening sides 36 of refractory trough 20 and also providing a stable surface for heater panels 22 to bear against without being damaged. It is important to note that flat surfaces 38 are provided between waves 34 and flat surfaces 40 are provided to supply support for heater panels 22 without inducing compressive damage.

A further preferred embodiment of the heated trough 10 of the present invention includes a coating 42 (see FIG. 1) of a high emissivity material on outer surface 44 of refractory trough 20. Such a coating can be sprayed or brushed on to surface 44 at a thickness of typically less than about 1 mm and may comprise materials having the ability to absorb and radiate thermal energy. Typical such materials are zirconium and chromium. While as depicted in the accompanying Figures, such a coating is shown specifically in connection with the embodiment of the invention depicted in FIG. 1, it will be readily understood that such a coating could be equally well applied in the various alternative preferred embodiments depicted in FIGS. 2-5.

While the invention has been described largely in connection with its use as a metal transfer trough, it will be readily understood by the skilled artisan that the principles of design and the physical configuration of the device is readily applicable to other molten metal handling devices such as holders, crucibles, and filters.

As the invention has been described, it will be apparent to those skilled in the art that the same may be varied in many ways without departing from the spirit and scope of the invention. Any and all such modifications are intended to be included within the scope of the appended claims.

What is claimed is:

1. A molten metal handling device, comprising:

(a) an outer shell defined by a bottom and two side walls and generally defining an inner cavity, and no top wall;

(b) an insulating layer with two side walls partially filling the outer shell, the insulating layer being adjacent to the outer shell bottom and two side walls;

(c) a homogeneous calcined castable refractory body for carrying molten metal, within the insulating layer, the refractory body defining an inner trough cavity; and (d) one or more heating elements each of which is positioned between and adjacent to the respective ones of the two side walls of the insulating layer, and also abutting the refractory body, with no heating element over the top of the inner trough cavity.

2. The molten metal handling device of claim 1 wherein said homogeneous calcined castable refractory comprises a silicon carbide or alumina castable refractory.

3. The molten metal handling device of claim 2 wherein said calcined alumina castable refractory comprises from about 60 to about 65 weight percent alumina and from about 25 to about 35 weight percent silica.

4. The molten metal handling device of claim 2 wherein said calcined silicon carbide castable refractory comprises from about 80 to about 85 weight percent silicon carbide and from about 10 to about 15 weight percent alumina.

5. The molten metal handling device of claim 1 further including a fence about the outer periphery of the calcined castable refractory body or cast internally to the calcined castable refractory body.

6. The molten metal handling device of claim 5 wherein the fence comprises a member selected from the group consisting of non-oxidizing metallic sheet, composite ceramic or glass fabric whose pores have been sealed with a ceramic slurry.

7. The molten metal handling device of claim 5 wherein said calcined castable refractory comprises a silicon carbide or alumina castable refractory.

8. The molten metal handling device of claim 1 wherein the calcined castable refractory body has an outer surface and the outer surface is coated with a high emissivity coating.

9. The molten metal handling device of claim 8 wherein the high emissivity coating comprises a material selected from the group consisting of zirconium and chromium.

10. The molten metal handling device of claim 8 further including a fence about the outer periphery of the calcined castable refractory body or cast internally to the calcined castable refractory body.

11. The molten metal handling device of claim 10 wherein the fence comprises a member selected from the group consisting of non-oxidizing metallic sheet, composite ceramic or glass fabric whose pores have been sealed with a ceramic slurry.

12. The molten metal handling device of claim 1 wherein the calcined castable refractory body has an outer surface that is cast in a wave pattern defined by individual waves.

13. The molten metal handling device of claim 12 wherein the wave pattern includes flat surfaces between the waves.

14. The molten metal handling device of claim 13 further including a fence cast internally to the calcined castable refractory body.

15. The molten metal handling device of claim 14 wherein the fence comprises a member selected from the group consisting of non-oxidizing metallic sheet, composite ceramic or glass fabric whose pores have been sealed with a ceramic slurry.

16. The molten metal handling device of claim 12 wherein the calcined castable refractory body has an outer surface and the outer surface is coated with a high emissivity coating.

17. The molten metal handling device of claim 16 wherein the high emissivity coating comprises a material selected from the group consisting of zirconium and chromium.

18. A molten metal handling device as recited in claim 1, and further wherein the conductive contact between the heating element and the refractory body is at least in part through a coating applied to one of the refractory body or the heating element.

19. A molten metal handling device, comprising:

an outer shell defined by a bottom and two side walls and generally defining an inner cavity, and no top wall;

an insulating layer partially filling the outer shell, the insulating layer adjacent the outer shell bottom and two side walls;

one or more heating elements positioned adjacent the insulating layer which is adjacent the two side walls within the inner cavity of the outer shell; and a homogeneous calcined castable refractory body for carrying molten metal, the refractory body defining an inner trough cavity and outer wall being positioned in an abutting relationship with the heating element.

20. A molten metal handling device as recited in claim 19 and further comprising a high emissivity layer between the one or more heating elements and the refractory body.

21. A molten metal handling device as recited in claim 1, and further wherein the outer shell with the bottom wall and two side walls defining the inner cavity does not include a top wall.

22. A molten metal handling device as recited in claim 1, and further wherein the outer shell is an open trough configuration with no upper wall.

23. A molten metal handling device as recited in claim 19, and further wherein the outer shell with the bottom wall and two side walls defining the inner cavity does not include a top wall.

24. A molten metal handling device as recited in claim 19, and further wherein the outer shell is an open trough configuration with no upper wall.

* * * * *